US007229037B1

(12) United States Patent
Hayles, Jr.

(10) Patent No.: US 7,229,037 B1
(45) Date of Patent: Jun. 12, 2007

(54) COMMINUTION APPARATUS

(76) Inventor: Peter E. Hayles, Jr., 225 Grover Rd., Toms River, NJ (US) 08753

( * ) Notice: Subject to any disclaimer, the term of this patent is extended or adjusted under 35 U.S.C. 154(b) by 0 days.

(21) Appl. No.: 11/522,816

(22) Filed: Sep. 18, 2006

(51) Int. Cl.
*B02C 1/10* (2006.01)
*B02B 1/00* (2006.01)

(52) U.S. Cl. ..... 241/39; 241/275

(58) Field of Classification Search ..... 241/275, 241/284, 39, 137, 80, 97
See application file for complete search history.

(56) References Cited

U.S. PATENT DOCUMENTS 4,166,583 A * 9/1979 Ruckstuhl ..... 241/73
5,887,809 A * 3/1999 Walters ..... 241/187
5,941,467 A * 8/1999 McArdle et al. ..... 241/5
7,055,769 B2 * 6/2006 Pierce ..... 241/187

* cited by examiner

*Primary Examiner*—Faye Francis
(74) *Attorney, Agent, or Firm*—Clifford G. Frayne

(57) ABSTRACT

These and other objects of the present invention are achieved by a comminution apparatus comprised of a housing member formed with co-planar circularly-shaped chambers in chordal juxtaposition to each other thereby forming a collision zone therebetween and wherein wheel members having radially disposed directional vanes are positioned for rotation in each cylindrically-shaped chamber and wherein an inlet fluid conduit or a slurry of particulate matter to be treated is in axial fluid communication with each wheel member and wherein each wheel member is caused to be rotated in a direction to accelerate the slurry towards the collision zone and to affect particle size reduction by particle collision and wherein an outlet conduit is in fluid communication with the collision zone for withdrawing a slurry of size reduced particles from the comminution apparatus.

5 Claims, 4 Drawing Sheets

COMMINUTION APPARATUS

Related Applications

Applicant is the holder of U.S. Pat. No. 7,059,552, issued Jun. 3, 2006, entitled "Comminution Apparatus" to which the present application relates as an improved embodiment thereof.

BACKGROUND OF THE INVENTION

1. Field of the Invention

The present invention relates to an apparatus for reduction of particle size, and more particularly to a comminution apparatus for uniformly disbursing solids within a liquid slurry to produce a homogeneous product.

2. Description of the Prior Art

A large number of manufacturing processes require for the uniform dispersion of dissimilar particulate materials to produce a homogeneous slurry product. Often, the starting particulate materials are irregular size, and must be reduced to a uniform size, such as a very fine powder, which are then uniformly dispersed within a solvent carrier to produce a master batch. This is particularly applicable in the arts of paints and printing inks.

Some prior art devices attempted to affect such process utilizing mechanical means wherein metal to metal surfaces crush the solid particles to achieve a uniform size for dispersion. Other prior art devices use an intermediate media, such as sand, shot, ceramic beads or stones to reduce particle size by causing such intermediate media to interact with the particulate materials to attempt to achieve uniform particle size for subsequent uniform dispersion and are limited by the characteristics and viscosity of the solvent carrier, particularly for low viscosity slurries. Additionally, such prior art devices accelerated wear on the equipment due to the inherent abrasive nature of the process.

OBJECTS OF THE INVENTION

An object of the present invention is to provide for a comminution apparatus for particle size reduction of low or high viscosity slurries obviating the use of intermediate solid media, such as sand, grit, shot or ceramic balls.

Another object of the present invention is to provide for a comminution apparatus obviating mechanical means to obtain particle size reduction.

Still another object of the present invention is to provide for a comminution apparatus wherein particles in the apparatus are caused to collide in a manner to obtain particle size reduction.

A still further object of the present invention is to provide for a comminution apparatus to achieve more uniform particle size and more uniform dispersion of particles in a solvent carrier thereby to obtain a more homogeneous product.

A still further object of the present invention is to provide a comminution apparatus which may analyze the outflow to control the input to obtain the optimum and desired dwell time and particle size.

SUMMARY OF THE INVENTION

These and other objects of the present invention are achieved by a comminution apparatus comprised of a housing member formed with co-planar circularly-shaped chambers in chordal juxtaposition to each other thereby forming a collision zone therebetween and wherein wheel members having radially disposed directional vanes are positioned for rotation in each cylindrically-shaped chamber and wherein an inlet fluid conduit having a slurry of particulate matter to be treated is in axial fluid communication with each wheel member, the inlet fluid conduit rotatable in relationship to the wheel members and having an elbow at its lower end for selective direction of the slurry of particulate matter to the directional vanes and wherein each wheel member is caused to be rotated in a direction to accelerate the slurry towards the collision zone and to affect particle size reduction by particle collision and wherein an outlet conduit is in fluid communication with the collision zone for withdrawing a slurry of size reduced particles from the comminution apparatus.

BRIEF DESCRIPTION OF THE DRAWINGS

A better understanding of the present invention will be obtained when consideration of the following detailed description thereof when taken with the accompanying drawings wherein like numerals indicate like parts throughout.

DETAILED DESCRIPTION OF THE INVENTION

Figure 1:
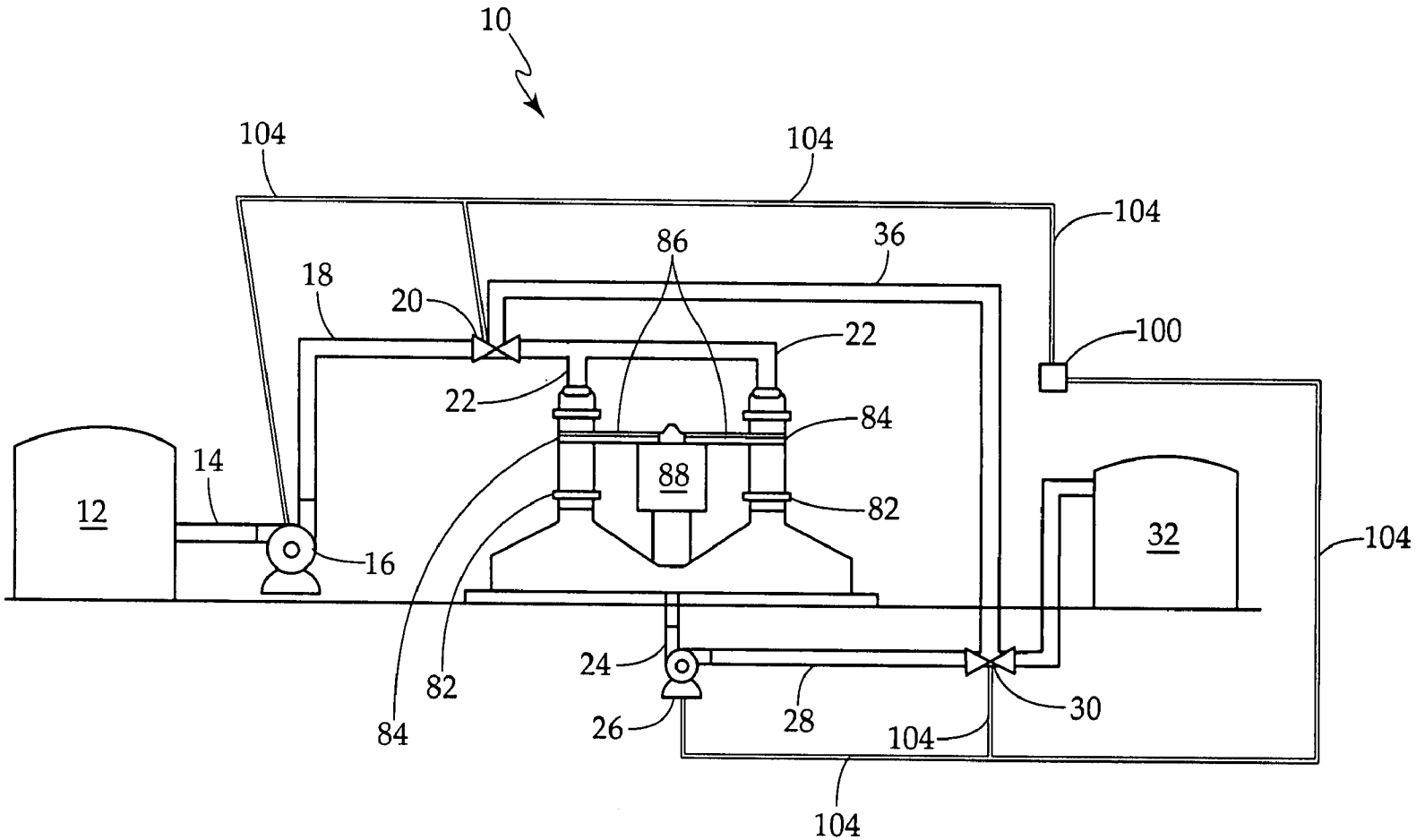
FIG. 1 is a schematic flow diagram of process and apparatus for particulate reduction including the comminution apparatus of the present invention.

Referring now to FIG. 1, there is illustrated the comminution apparatus of the present invention generally indicated as 10, positioned within a system for treating a slurry of particulate material for particle size reduction. The system includes a storage tank 12 for the slurry of particulate material in fluid communication via a conduit 14 with the suction side of a pump 16. The discharge side of pump 16 is in fluid communication via a conduit 18, including a valve 20 to inlet conduits 22 of the comminution apparatus 10 as more fully hereinafter described. An outlet conduit 24 of the comminution apparatus 10 is in fluid communication with the suction side of a pump 26 with the discharge side thereof being in fluid communication via a conduit 28, including a valve member 30 to a product storage tank 32 for the product slurry of reduced particulate material. A recycle conduit 36 is in fluid communication between valves 20 and 30 to provide recycle requirements for the system.

Figure 2:
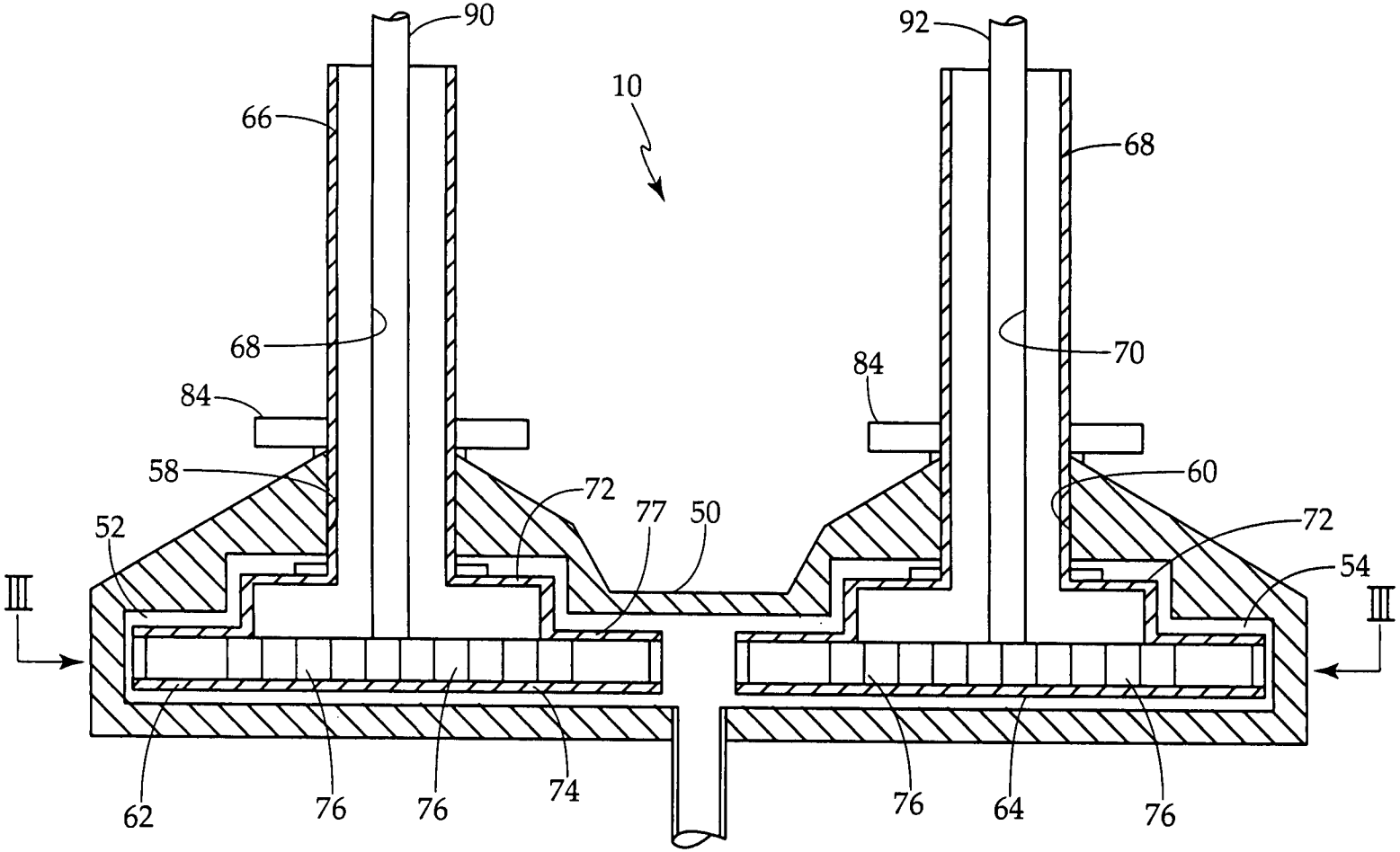
FIG. 2 is a cross section view of the comminution apparatus of the present invention taken along a vertical plane of an access of rotation of the wheel member.
Figure 3:
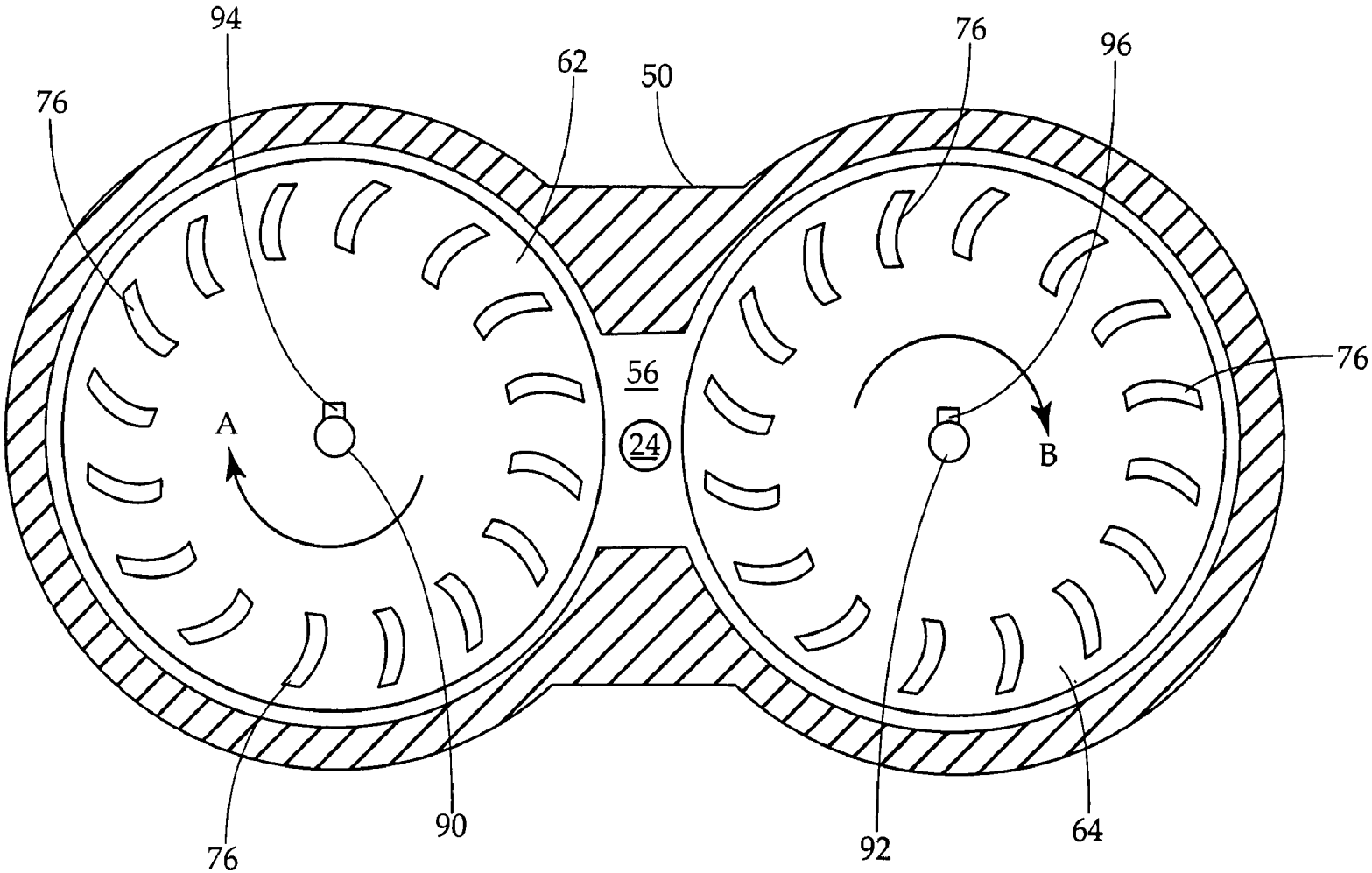
FIG. 3 is a cross sectional view of the comminution apparatus taken along the plane III—III of FIG. 2.

Referring now to FIGS. 1, 2 and 3, the comminution apparatus 10 of the present invention is comprised of a housing member 50 formed with coplanar, circularly-shaped chambers 52 and 54 in chordal juxtaposition or tangential communication thereby forming a collision zone 56 therebetween with vertically-disposed cylindrically-shaped channels 58 and 60 in housing chamber 50 extending downwardly in coaxial alignment with the chambers 52 and 54 respectively as more fully hereinafter described.

Positioned with the cylindrically-shaped chambers 52 and 54 there is provided a wheel member generally indicated as 62 and a wheel member generally indicated as 64 mounted to shaft members 66 and 68 respectively, defining cylindrically-shaped channels 68 and 70.

The wheel members 62 and 64 are comprised of an upper hub plate member 72 secured to shaft members 66 and 68 respectively, pub plate member 72 being secured to an upper circularly shaped plate member 73, and which in turn is secured to a lower circularly-shaped plate member 74 between which there are positioned a plurality of radially disposed, arcuately-shaped vane members 76 which in rotational movement of the wheel member 62 in counter-clockwise direction as indicated by arrow "A" causes material being processed to be radially accelerated outwardly from within the wheel member 62. The wheel member 64 in an identical manner which in rotational movement of the wheel member 64 in counter-clockwise direction as indicated by the arrow "B", cause material being process to be radially accelerated outwardly from within the wheel member 64 and collide in the collision zone 56 with the material from wheel member 62.

The shafts 66 and 68 are positioned for rotation in the channels 58 and 60 including sealing means 82. Shafts 66 and 68 may be rotated by any one of a number of methods. FIG. 2 illustrates one means of rotation for explanatory purposes, but other methods or means may be utilized without departing from the spirit and scope of the invention. Mounted to the shafts 66 and 68 are gear members 84 about which is coursed drive means 86 in geared relationship with a motor 88 referring more particularly to FIG. 1. The collision zone 56 is in fluid communication with outlet conduit 24.

Figure 4:
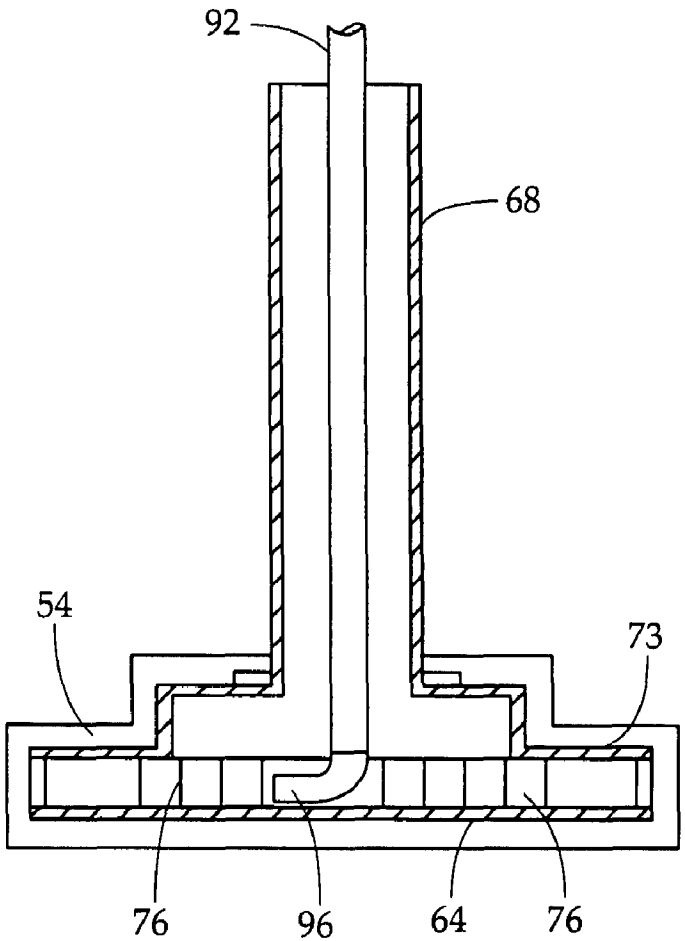
FIG. 4 is a section view of area A of the lower end of the inlet conduit and wheel member.

In Applicant's prior application Ser. No. 10/357,052, now U.S. Pat. No. 7,059,552, the slurry of particulate matter to be processed were introduced into chambers 52 and 54 by means of channels formed in shaft members 66 and 68 respectively. In the present invention, the slurry of particulate matter is introduced by means of a second tubular shaft member, 90 and 92 respectively, positioned within the tubular portion of shaft members 66 and 68. Tubular shaft members 90 and 92 are formed with an elbow, 94 and 96 respectively, at their lower ends within circularly-shaped chambers 52 and 54 (See FIG. 4). Tubular shafts 90 and 92 and their respective lower elbows 94 and 96 are rotatable within shaft members 66 and 68 respectively. This allows for the slurry of particulate matter to be discharged from the elbow, 94 and 96 respectively, and aimed at a particular angle with respect to wheel member 62 and 64, and allow the operator to optimize the collision process between the particulate matter in the slurry within the collision zone 56. FIG. 4 is a close up cutaway view of circular chambers 52 and 54, shaft members 66 and 68, and tubular shaft members 90 and 92, with elbows 94 and 96.

In operation, a slurry of particulate matter to be processed is passed from the storage source by pump 16 via conduits 14, 18 and 22 under the control of valve 20 to the comminution apparatus 10. The slurry is passed through the shafts 90 and 92 and through upper hub plates and selectively, angularly introduced into wheel members 62 and 64 by elbow ends 94 and 96 and counter-clockwise rotated by the drive motor 88. The slurry in each wheel member is caused to accelerate outwardly towards the collision zone 56 and thereby cause particulate matter in the slurry exiting from wheel member 62 to impinge upon the particulate material in the slurry exiting wheel member 64 resulting in particle size reduction of particulate material in the liquid carrier and thereby forming a slurry of particulate matter of reduced size and preferably in a homogeneous slurry.

The resulting homogeneous slurry is withdrawn via conduit 24 from the comminution apparatus 10 and passed via conduit 28 by pump 26 under control of valve 30 to a product storage tank 32. Recycle conduit 36 provides process control to a desired particle size.

In this embodiment of the comminution apparatus, there may also incorporated a feedback control to control the quantity of slurry with particulate matter being processed, and the dwell time of the slurry with particulate matter within the apparatus. This feedback control can be either manual or electronic. The feedback control (See FIG. 1) comprises a test station 100 which is in communication with and can exercise control over suction side pump 20, valve 20, pump 26, and valve 30. The process slurry and particulate matter can either be examined physically or electronically at test station 100 to determine if the desired particle size is being achieved. In turn, the amount of slurry and particulate matter being introduced by suction pump 16, and released by pump 26, and that portion of the slurry being recycled via valve 30 and valve 20, can be controlled so as to increase or decrease the dwell time of the slurry and particulate matter within cylindrically-shaped chambers 52 and 54. This feedback control can be accomplished by an operator taking a manual sample of the slurry and particulate matter at or before the storage tank and physically conducting tests to determine particle size distribution or a portion of the slurry and particulate matter may pass through a preset light meter or equivalent electrical apparatus to automatically determine the particulate size and adjust the aforesaid pumps and valves accordingly via electrical communication lines 104.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. A comminution assembly for size reduction of particles in a slurry thereof to form a homogeneous product which 1comprises:

a housing formed with circularly-shaped chambers in tangential communication defining a contact zone;

an outlet conduit in fluid communication with said contact zone for drawing said homogeneous product from said housing;

a disk member positioned in each of said chambers, said disk member comprised of an upper plate member having a circularly-shaped opening, a lower base plate member, and a plurality of radially extending vanes mounted to and disposed between said plate members;

a hollow shaft member perpendicularly mounted to each of said upper plate members of each of said disk members;

an inlet shaft member positioned in each of said hollow shaft members, said inlet shaft members having an elbow horizontally disposed between said upper plate member and said lower plate member, said shaft member and said elbow rotatable with respect to said hollow shaft members and said disk members to guide said particulate matter in said slurry to said vanes for introducing said slurry into said disk member; and means for rotating said hollow shaft members and disk members to accelerate said slurry towards said contact zone to effect particle to particle contact and therefore size reduction to form said homogeneous product.

2. The comminution apparatus as defined in claim 1 wherein said vanes are arcuate in shape to facilitate acceleration of said slurry.

3. The comminution apparatus as defined in claim 1 wherein said disk members rotate in like directions to cause said slurry from each wheel member to collide in opposite directions.

4. The comminution assembly as defined in claim 1 and further including conduit means for recirculating said homogeneous product.

5. The comminution assembly as defined in claim 4 wherein said comminution assembly comprises a feed back circuit to measure particle size reduction and control the introduction and removal of slurry from said housing and the concomitant dwell time of said slurry in said housing.

* * * * *